US010126687B2

(12) United States Patent
Fukuyama et al.

(10) Patent No.: US 10,126,687 B2
(45) Date of Patent: Nov. 13, 2018

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventors: Hirotaka Fukuyama, Misahima Shizuoka (JP); Sunao Takenaka, Odawara Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/394,131

(22) Filed: Dec. 29, 2016

(65) Prior Publication Data

US 2018/0188671 A1 Jul. 5, 2018

(51) Int. Cl.
*G03G 15/16* (2006.01)

(52) U.S. Cl.
CPC ..... *G03G 15/161* (2013.01)

(58) Field of Classification Search
CPC ..... G03G 15/1675; G03G 15/1605; G03G 15/161; G03G 21/1647
See application file for complete search history.

(56) References Cited

U.S. PATENT DOCUMENTS 6,633,737 B1 * 10/2003 Tanaka ..... G03G 15/0178 399/301
2014/0119759 A1 * 5/2014 Yamaura ..... G03G 15/168 399/66

FOREIGN PATENT DOCUMENTS

JP 2007304335 11/2007

* cited by examiner

*Primary Examiner* — Walter L Lindsay, Jr.
*Assistant Examiner* — Jessica L Eley
(74) *Attorney, Agent, or Firm* — Patterson & Sheridan, LLP

(57) ABSTRACT

An image forming apparatus according to an embodiment includes an image forming unit that forms a toner image on an image carrier body. A primary transfer member transfers the toner image formed on the image carrier body onto an intermediate transfer body. A secondary transfer member transfers the toner image from the intermediate transfer body onto a recording medium. A control unit applies a cleaning bias to the secondary transfer member while an idle operation of the secondary transfer member is being performed before the toner image is secondarily transferred onto the transferring target material.

14 Claims, 8 Drawing Sheets

IMAGE FORMING APPARATUS

FIELD

Embodiments described herein relate generally to an image forming apparatus.

BACKGROUND

In an image forming apparatus, during a printing operation of printing a plurality of pages, it may take time to retrieve image information for the next page and the printing operation of the next page may not be performed immediately. In this case, the image forming apparatus stops the printing operation first and then starts the printing operation again at a stage in which a procedure to retrieve the image information of the next page is completed. However, once the printing operation is stopped, time is required to start the printing operation. Therefore, it takes a long time to complete the printing operation of all pages, and productivity may be lowered.

Therefore, a method for shortening time until the printing operation of all pages is completed, by performing an idle operation of a secondary transfer roller until the procedure to get the image information is completed, has been proposed. However, if the idle operation is performed for a long time, fine fog toner may accumulate on the secondary transfer roller and the accumulated toner may adhere to the next page.

DETAILED DESCRIPTION

An image forming apparatus of an embodiment includes an image carrier body, an intermediate transfer body, an exposure device configured to form an electrostatic latent image on the image carrier body based on image data, a developing device configured to provide toner to the image carrier body having the electrostatic latent image formed thereon to thereby form a toner image on the image carrier body, a primary transfer member configured to transfer the toner image formed on the image carrier body onto the intermediate transfer body, a secondary transfer member configured to perform a transfer operation in which the toner image is transferred from the intermediate transfer body onto a recording medium and an idle operation in which no toner image is transferred, and a control unit configured to apply a cleaning bias to the secondary transfer member while the idle operation of the secondary transfer member is being performed before the toner image is secondarily transferred onto the transferring target material.

Figure 1:
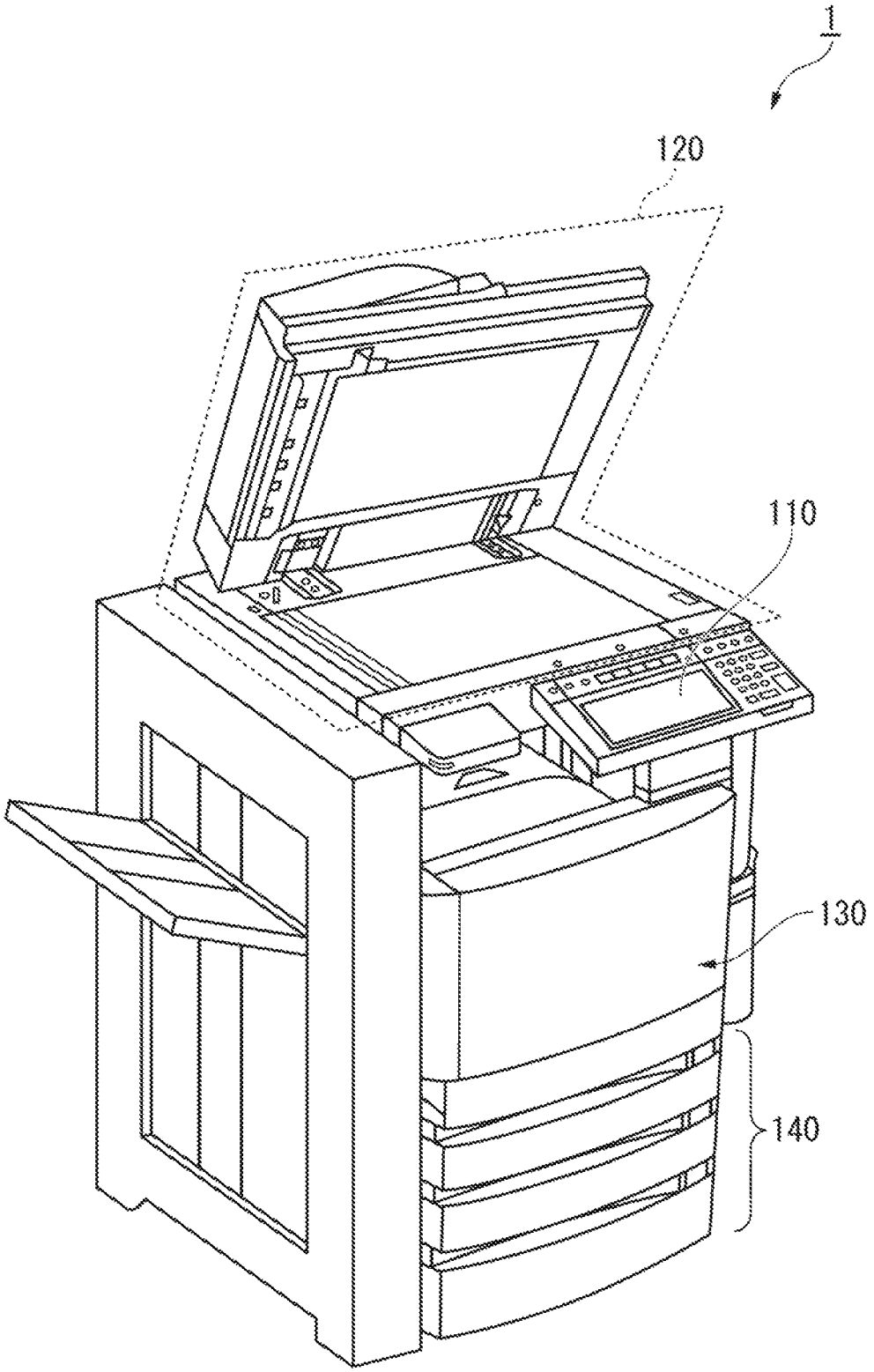
FIG. 1 illustrates an example configuration of an image forming apparatus according to an embodiment.

The image forming apparatus according to the embodiment will be described with reference to the drawings. FIG. 1 is a view illustrating an example configuration of an image forming apparatus 1 of the embodiment. For example, the image forming apparatus 1 is a Multi-Function Peripheral (MFP).

The image forming apparatus 1 includes a display unit 110, an image reading unit 120, an image forming unit 130, and a paper feeding unit 140.

The display unit 110 operates as an output interface that displays characters and images. The display unit 110 also operates as an input interface that receives an instruction from a user. For example, the display unit 110 may be a liquid crystal display having a touch panel.

The image reading unit 120 is a color scanner. The image reading unit 120 reads an image that is formed on a recording medium. The image reading unit 120 converts the read image on the medium into digital data. For example, the image reading unit 120 may include a Contact Image Sensor (CIS) or a Charge Coupled Devices (CCD). For example, the recording medium may be a sheet that is a copy target.

The image forming unit 130 forms a toner image on a recording medium. The image forming unit 130 forms the image on the recording medium based on the image data read by the image reading unit 120 or based on image data received from an external device.

The paper feeding unit 140 houses sheets that are the recording mediums. For example, the sheet may be an unused sheet or a reused sheet. The paper feeding unit 140 supplies the recording medium to the image forming unit 130.

Next, toner that is used in the image forming unit 130 will be described. A color toner is used in the image forming unit 130 of the embodiment. The color toner may be one or more toner, each containing pigments of yellow (Y), magenta (M), cyan (C), or black (K). That is, the color toner is at least one toner among yellow toner, magenta toner, cyan toner, and black toner.

Figure 2:
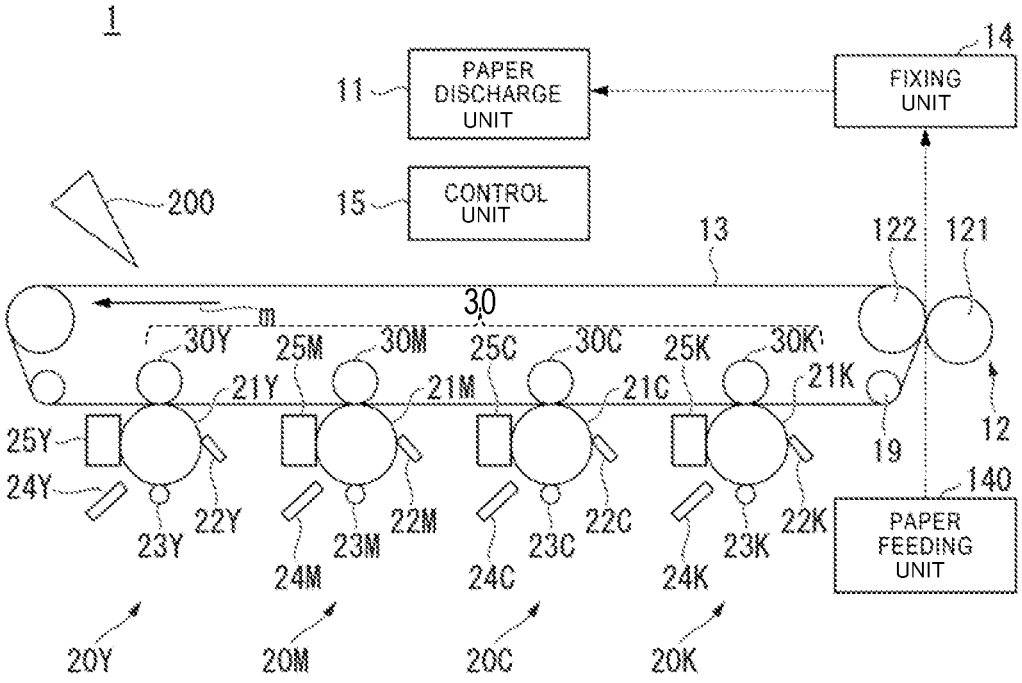
FIG. 2 illustrates an example schematic configuration of the image forming apparatus.

FIG. 2 illustrates an example schematic configuration of the image forming apparatus 1.

The image forming apparatus 1 is an intermediate transfer type image forming apparatus. The image forming apparatus 1 includes a paper discharge unit 11, a primary transfer unit 30, a secondary transfer unit 12 (counter roller 122 and a secondary transfer roller 121), an intermediate transfer belt (intermediate transfer body) 13, a fixing unit 14, the control unit 15, and the paper feeding unit 140.

The paper discharge unit 11 discharges a sheet on which a fixing process is performed by the fixing unit 14 to a paper discharge space (not illustrated).

The primary transfer unit 30 includes an image forming station 20Y, an image forming station 20M, an image forming station 20C, an image forming station 20K, a primary transfer roller 30Y (primary transfer member), a primary transfer roller 30M (primary transfer member), a primary transfer roller 30C (primary transfer member), and a primary transfer roller 30K (primary transfer member).

The image forming station 20Y is disposed on an upstream side of the image forming station 20M. The image forming station 20Y includes a photoconductor 21Y (image carrier body), a photoconductor cleaner 22Y, a charging device 23Y, an exposure device 24Y, and a developing device 25Y.

The image forming station 20M is disposed on the upstream side of the image forming station 20C. The image forming station 20M includes a photoconductor 21M (image carrier body), a photoconductor cleaner 22M, a charging device 23M, an exposure device 24M, and a developing device 25M.

The image forming station 20C is disposed on the upstream side of the image forming station 20K. The image forming station 20C includes a photoconductor 21C (image carrier body), a photoconductor cleaner 22C, a charging device 23C, an exposure device 24C, and a developing device 25C.

The image forming station 20K is disposed on a downstream side of the image forming station 20C. The image forming station 20K includes a photoconductor 21K (image carrier body), a photoconductor cleaner 22K, a charging device 23K, an exposure device 24K, and a developing device 25K.

The photoconductors 21Y, 21M, 21C, and 21K have organic photoconductors (OPC) on surfaces.

The photoconductor cleaners 22Y, 22M, 22C, and 22K remove residual toner on the surfaces of the respective photoconductors 21Y, 21M, 21C, and 21K. Residual toner is toner remaining on the surface of the photoconductor after the primary transfer.

The charging devices 23Y, 23M, 23C, and 23K uniformly charge the surfaces of the photoconductors 21Y, 21M, 21C, and 21K, respectively. For example, the charging devices 23Y, 23M, 23C, and 23K are scorotron type corona chargers.

The exposure devices 24Y, 24M, 24C, and 24K acquire image data from the control unit 15. The exposure devices 24Y, 24M, 24C, and 24K irradiate the photoconductors 21Y, 21M, 21C, and 21K with laser beam in accordance with the acquired image data. The exposure devices 24Y, 24M, 24C, and 24K scan the photoconductor 21Y, 21M, 21C, and 21K with the laser beam in an axial direction. Electrostatic latent images are formed on the photoconductors 21Y, 21M, 21C, and 21K by scanning exposure of the laser beam.

The developing devices 25Y, 25M, 25C, and 25K respectively include a developing roller and a developing motor.

The developing device 25Y houses Y developer. The developing device 25M houses M developer. The developing device 25C houses C developer. The developing device 25K houses K developer.

Each developer is a mixture of toner and a magnetic carrier. The Y developer housed in the developing device 25Y is a mixture of yellow toner and a magnetic carrier. The M developer housed in the developing device 25M is a mixture of magenta toner and a magnetic carrier. The C developer housed in the developing device 25C is a mixture of cyan toner and a magnetic carrier. The K developer housed in the developing device 25K is a mixture of black toner and a magnetic carrier.

The developing device 25Y applies a developing bias to the developing roller. The developer Y is transferred to the photoconductor 21Y by the developing bias. Thus, the electrostatic latent image formed on the photoconductor 21Y is formed by the exposure device 24Y as a toner image of the yellow toner.

The developing device 25M applies a developing bias on the developing roller. The developer M is transferred to the photoconductor 21M by the developing bias. Thus, the electrostatic latent image formed on the photoconductor 21M is formed by the exposure device 24M as a toner image of the magenta toner.

The developing device 25C applies a developing bias on the developing roller. The developer C is transferred to the photoconductor 21C by the developing bias. Thus, the electrostatic latent image formed on the photoconductor 21C is formed by the exposure device 24C as a toner image of the cyan toner.

The developing device 25K applies a developing bias on the developing roller. The developer K is transferred to the photoconductor 21K by the developing bias. Thus, the electrostatic latent image formed on the photoconductor 21K is formed by the exposure device 24K as a toner image of the black toner.

The intermediate transfer belt 13 abuts against the primary transfer unit 30. The intermediate transfer belt 13 is supported by a backup roller 17, a driven roller 18 and a tension roller 19. The intermediate transfer belt 13 rotates in an arrow direction m.

The primary transfer roller 30Y, the primary transfer roller 30M, the primary transfer roller 30C, and the primary transfer roller 30K are conductive rollers.

The primary transfer roller 30Y presses the photoconductor 21Y via the intermediate transfer belt 13. In addition, a primary transfer bias $V_1$ is applied to the primary transfer roller 30Y. Therefore, the toner image is transferred (primarily transferred) onto the intermediate transfer belt 13.

The primary transfer roller 30M presses the photoconductor 21M via the intermediate transfer belt 13. In addition, a primary transfer bias $V_1$ is applied to the primary transfer roller 30M. Therefore, the toner image is transferred (primarily transferred) onto the intermediate transfer belt 13.

The primary transfer roller 30C presses the photoconductor 21C via the intermediate transfer belt 13. In addition, a primary transfer bias $V_1$ is applied to the primary transfer roller 30C. Therefore, the toner image is transferred (primarily transferred) onto the intermediate transfer belt 13.

The primary transfer roller 30K presses the photoconductor 21K against the intermediate transfer belt 13. In addition, a primary transfer bias $V_1$ is applied to the primary transfer roller 30K. Therefore, the toner image is transferred (primarily transferred) onto the intermediate transfer belt 13. Here, the primary transfer bias $V_1$ is applied to the primary transfer roller 30Y, the primary transfer roller 30M, the primary transfer roller 30C, and the primary transfer roller 30K in this order. That is, the intermediate transfer belt 13 is transported in the transfer regions of the image forming stations 20Y, 20M, 20C, and 20K in this order.

A sheet is supplied to the secondary transfer unit 12 from the paper feeding unit 140.

The secondary transfer unit 12 includes the secondary transfer roller (secondary transfer member) 121 and the counter roller 122.

The secondary transfer unit 12 is disposed on a downstream side of the image forming station 20K. The secondary transfer roller 121 is positioned to face the counter roller 122 against the intermediate transfer belt 13. The secondary transfer roller 121 is a conductive roller. A predetermined secondary transfer bias $V_2$ is applied to the secondary transfer roller 121. Therefore, the secondary transfer roller 121 transfers (secondarily transfers) the toner image on the intermediate transfer belt 13 onto a sheet from the paper feeding unit 140. Moreover, after completion of the secondary transfer, the intermediate transfer belt 13 is cleaned by a belt cleaner 200.

The fixing unit 14 heats, presses, and fixes a sheet onto which the toner image is transferred. For example, the fixing unit 14 is a fixing device using electromagnetic induction heating.

Figure 3:
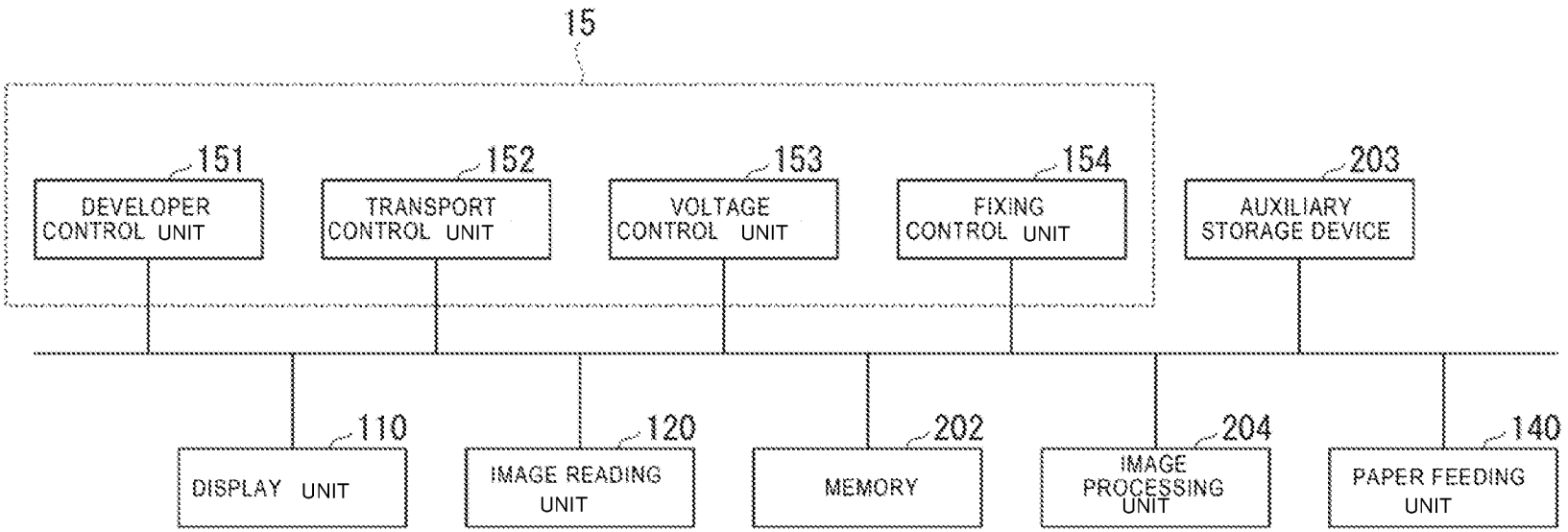
FIG. 3 is a function block diagram illustrating a control unit of the image forming apparatus.

FIG. 3 is a function block diagram illustrating the control unit 15 of the image forming apparatus 1.

The image forming apparatus 1 includes the control unit 15, a memory 202, an auxiliary storage device 203, the display unit 110, the image reading unit 120, the paper feeding unit 140, and an image processing unit 204.

The control unit 15 executes an image forming program. For example, the image forming program is stored in the auxiliary storage device 203 in advance and is read to the memory 202 by the control unit 15. The image forming apparatus 1 executes a printing process for forming an image on the recording medium by executing the image forming program.

The control unit 15 includes a developer control unit 151, a transport control unit 152, a voltage control unit 153, and a fixing control unit 154.

The developer control unit 151 controls the developing roller and the developing motor of each of the developing devices 25Y, 25M, 25C, and 25K. That is, the developer control unit 151 applies the developing bias to the developing roller. In addition, the developer control unit 151 drives the developing motor.

The developer control unit 151 forms the toner image on the photoconductor 21Y by controlling the developing roller and the developing motor of the developing device 25Y. The developer control unit 151 forms the toner image on the photoconductor 21M by controlling the developing roller and the developing motor of the developing device 25M. The developer control unit 151 forms the toner image on the photoconductor 21C by controlling the developing roller and the developing motor of the developing device 25C. The developer control unit 151 forms the toner image on the photoconductor 21K by controlling the developing roller and the developing motor of the developing device 25K.

The transport control unit 152 controls a plurality of transport rollers (hereinafter, referred to as "transport device") such as the intermediate transfer belt 13.

The voltage control unit 153 applies the primary transfer bias $V_1$ to the primary transfer rollers 30Y, 30M, 30C, and 30K in this order. Therefore, the toner images of yellow (Y), magenta (M), cyan (C), and black (K) are transferred to the intermediate transfer belt 13 in this order.

The voltage control unit 153 applies the secondary transfer bias $V_2$ to the secondary transfer roller 121. Therefore, the toner images stacked on the intermediate transfer belt 13 are secondarily transferred on the sheet.

Here, fog toner other than the toner image due to residual charge may adhere to the secondary transfer roller 121 from the photoconductors 21Y, M, C, and K via the intermediate transfer belt 13. Therefore, the voltage control unit 153 applies a cleaning bias $V_{CB}$ to the secondary transfer roller 121 and thereby reversely transfers the fog toner on the secondary transfer roller 121 onto the intermediate transfer belt 13. Thus, the fog toner that is reversely transferred onto the intermediate transfer belt 13 is cleaned by the belt cleaner 200. Therefore, the image forming apparatus 1 can remove the fog toner. An absolute value of the cleaning bias $V_{CB}$ is a voltage value that is lower than an absolute value of the secondary transfer bias $V_2$. In addition, the cleaning bias $V_{CB}$ is a voltage of at least one of positive and negative polarities. An application time of the cleaning bias $V_{CB}$ is, for example, a time (hereinafter, referred to as "revolution time") in which the secondary transfer roller 121 completes one revolution or more. For example, if the cleaning bias $V_{CB}$ is sequentially applied as the positive voltage and the negative voltage, the application time of both voltages is the revolution time.

The voltage control unit 153 applies the cleaning bias $V_{CB}$ to the secondary transfer roller 121 if the idle operation of the secondary transfer roller 121 is performed before transferring the toner image onto a sheet of the next page. A time before transferring the toner image onto the sheet of the next page is a time period until the secondary transfer of the toner image is started onto the sheet of the next page after completion of the secondary transfer onto the previous page. The idle operation is a state where the secondary transfer roller 121 continuously rotates without applying the secondary transfer bias $V_2$ thereto. That is, in a state where the secondary transfer bias $V_2$ is turned off after the secondary transfer of image for one page is completed, the secondary transfer roller 121 rotates during an idle time. The idle time is a time in which the idle operation is executed.

That is, the voltage control unit 153 applies the cleaning bias $V_{CB}$ to the secondary transfer roller 121 if the secondary transfer roller 121 performs the idle operation. Thus, the voltage control unit 153 applies the secondary transfer bias $V_2$ to the secondary transfer roller 121 after the application of the cleaning bias $V_{CB}$.

The control unit 15 proceeds to retrieve an the image data corresponding to the toner to be transferred onto the sheet. Here, the image procedure indicates that the image data is in a state of being capable of immediately outputting to the exposure devices 24Y, M, C, and K. In the control unit 15, if sheets of a plurality of pages are printed, it may take a time to proceed to retrieve the image data for the next page. In this case, the control unit 15 causes the secondary transfer roller 121 to wait by performing the idle operation of the secondary transfer roller 121 until the next secondary transfer after the procedure to retrieve the image data is completed. If a time for performing the idle operation exceeds a predetermined period of time, the control unit 15 applies the cleaning bias $V_{CB}$ to the secondary transfer roller 121 to prevent backside contamination of a sheet due to contamination of the secondary transfer roller 121. In the embodiment, the control unit 15 determines whether or not the cleaning operation is performed depending on whether or not a time until exposure of an image of the next page is started after the secondary transfer is completed for one page. Substantially, it is determined whether or not a time until the secondary transfer of the image of the next page is performed after the secondary transfer of the image is completed for one page exceeds a predetermined time. However, the control unit 15 may determine whether or not the cleaning operation is performed after a time (hereinafter, referred to as "procedure completion time") until the procedure to retrieve the image data is completed.

Moreover, the rotation of each of the photoconductors 21Y, M, C, and K, driving of each of the charging devices 23Y, M, C, and K, and driving of each of the developing devices 25Y, M, C, and K continues even after one printing job is completed. Thus, if the image data for the next printing job is retrieved, the exposure devices 24Y, M, C, and K form the toner image on each of the photoconductors 21Y, M, C, and K by starting the exposure. Moreover, in the embodiment, the photoconductor 21 of each of the image forming stations 20Y, M, C, and K, the charging device 23, and the developing device 25 are referred to as the image forming unit. As described above, the image forming unit continues an operation for forming the toner image even if one printing job is completed.

The fixing control unit 154 controls drive of the fixing unit 14.

Figure 4:
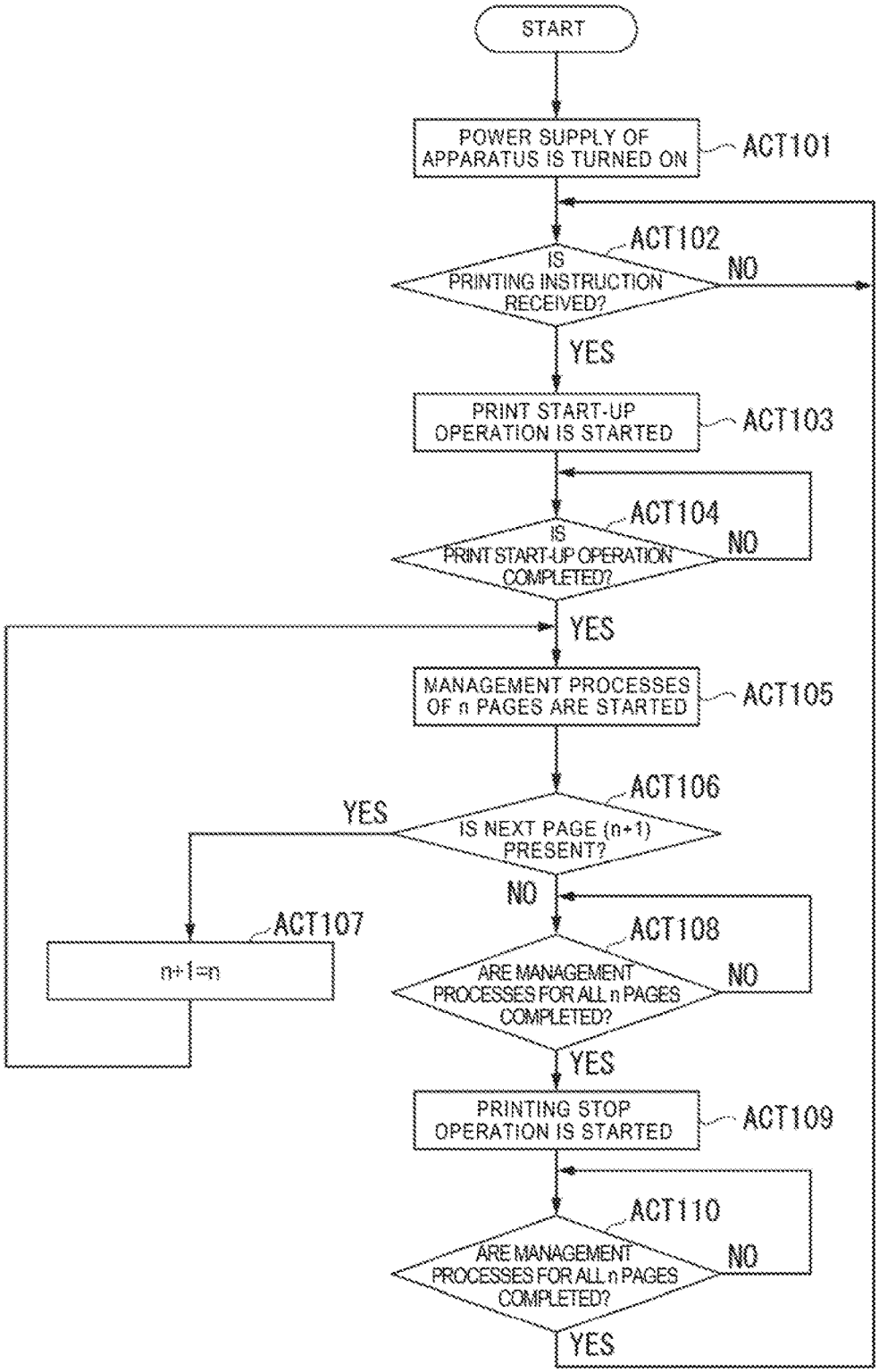
FIG. 4 is a flow chart illustrating an example sequence of operations of a printing process of a plurality of pages in the image forming apparatus.

Hereinafter, the operation of the printing process of the plurality of pages of the image forming apparatus 1 will be described with reference to the drawings. FIG. 4 is a flow chart illustrating an example sequence of operations of the printing process of the plurality of pages of the image forming apparatus 1.

After a power supply of the image forming apparatus 1 is turned on by the user (ACT101), it is determined whether or not the image forming apparatus 1 receives a printing instruction for printing an image (ACT102). For example, if the printing instruction is input into the image forming apparatus 1 from the display unit 110 by the user, it is determined that there is the printing instruction.

If it is determined that there is the printing instruction, the image forming apparatus 1 starts a print start-up operation for printing the image (ACT103). When the print start-up operation is started, the developer control unit 151 drives the developing motor thereby driving the photoconductors 21Y, M, and C that are the color photoconductors and the photoconductor 21K that is the BK photoconductor. The transport control unit 152 drives a plurality of transport rollers such as the intermediate transfer belt 13. In addition, the charging devices 23Y, 23M, 23C, and 23K uniformly charge the surface of each of the photoconductors 21Y, 21M, 21C, and 21K. Thus, the developing devices 25Y, 25M, 25C, and 25K are driven by applying the developing bias. In addition, a developing DC bias and a developing AC bias are applied to each developing sleeve (not illustrated) of the developing devices 25Y, 25M, 25C, and 25K. Therefore, the print start-up operation is completed.

The image forming apparatus 1 determines whether or not the print start-up operation is completed (ACT104). If it is determined that the print start-up operation is completed, the image forming apparatus 1 starts a page management process for managing the printing process of the n pages (ACT105). The n is an integer of 1 or more and indicates the current page number.

The image forming apparatus 1 confirms presence or absence of the next page (n+1) after the page management processes of the n pages are started (ACT106). Thus, if there is the next page, the image forming apparatus 1 performs increment of 1 and the process proceeds to ACT105. As described above, if the plurality of pages are printed, the image forming apparatus 1 sequentially starts the page management process for each page.

On the other hand, in ACT106, if there is no next page, the image forming apparatus 1 determines whether or not all the page management processes are completed (ACT108).

If it is determined that all the page management processes are completed, the image forming apparatus 1 starts a printing stop operation (ACT109). Thus, the image forming apparatus 1 determines whether or not the printing stop operation is completed (ACT110). If it is determined that the printing stop operation is completed, the process returns to ACT102 and the image forming apparatus 1 waits for the next printing instruction.

Figure 5:
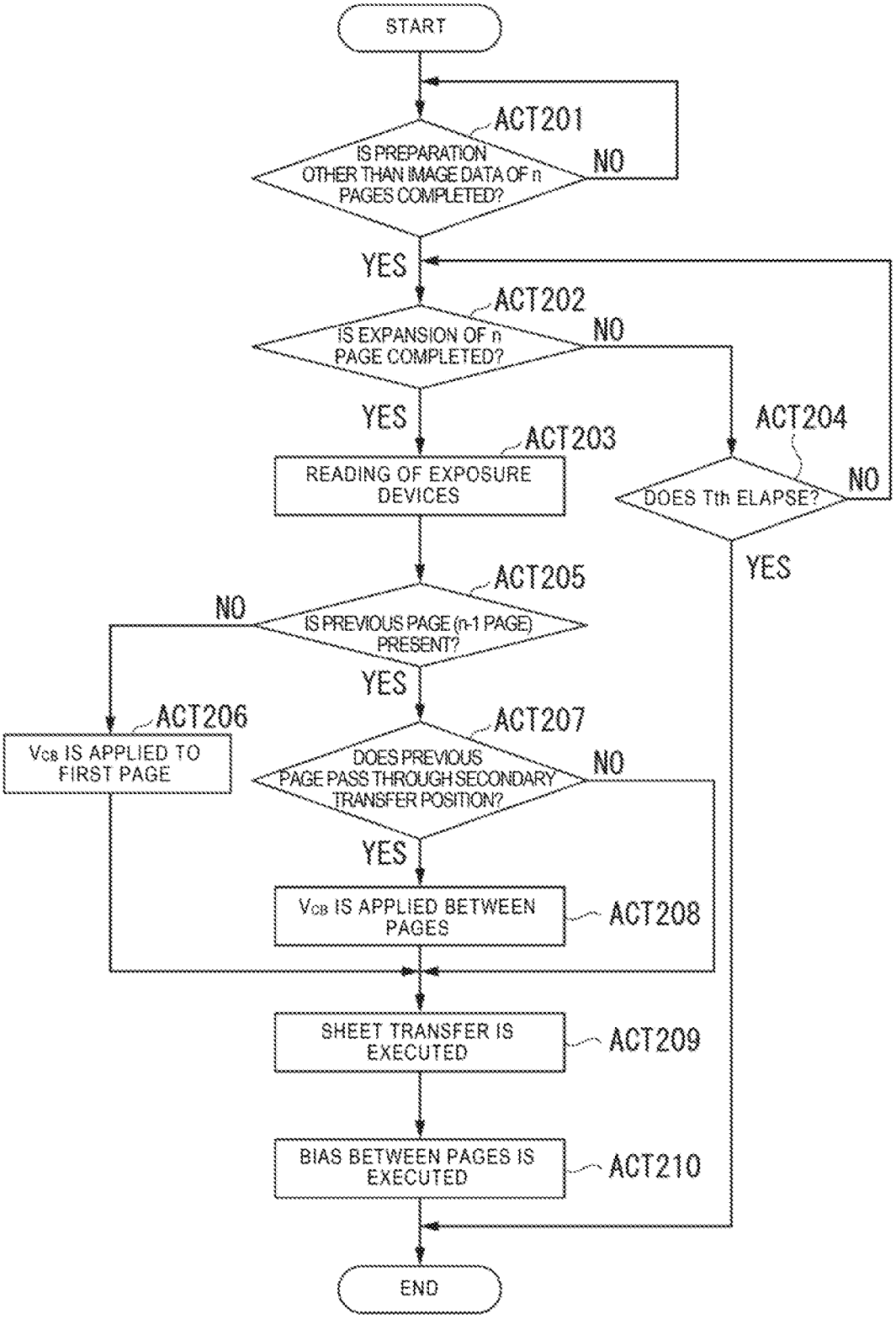
FIG. 5 is a flow chart illustrating an example sequence of operations of a page management process of the image forming apparatus.

Next, the page management process in the embodiment will be described with reference to the drawings. FIG. 5 is a flow chart illustrating an example sequence of operations of the page management process of the image forming apparatus 1.

If the page management process is started, the image forming apparatus 1 determines whether or not a preparation other than the image procedure to retrieve the image data of predetermined pages is completed (ACT201). If the preparation other than the image procedure to retrieve the image data is completed, the image forming apparatus 1 performs the image procedure to retrieve the image data of the pages. The image forming apparatus 1 determines whether or not a time from when the secondary transfer of the previous page is completed to when the exposure of the next image data is started (after the procedure to retrieve the image data is completed) exceeds a predetermined time (ACT202). If it is determined that the image procedure to retrieve the image data of the pages is completed, the image forming apparatus 1 starts the exposure of the exposure devices 24Y, 24M, 24C, and 24K (ACT203). That is, the exposure devices 24Y, 24M, 24C, and 24K irradiate the photoconductors 21Y, 21M, 21C, and 21K with the laser beam corresponding to the image data that is image-proceeded by the control unit 15. Therefore, the toner images are formed on the photoconductors 21Y, 21M, 21C, and 21K. Thus, each toner image is transferred onto the intermediate transfer belt 13.

On the other hand, if it is determined that the image procedure to retrieve the image data of the pages is not completed, the image forming apparatus 1 determines whether or not the predetermined time $T_{th}$ elapses (ACT204). If the predetermined time $T_{th}$ elapses, the image forming apparatus 1 stops the printing operation of the pages first.

The image forming apparatus 1 determines whether or not the previous page (n−1 page) is present during the same printing operation (ACT205). Whether or not the previous page (n−1 page) is present is indicated by whether or not an instruction of the printing operation of the previous page (n−1 page) is present. If it is determined that the previous page (n−1 page) is present in the same printing operation, the image forming apparatus 1 determines whether or not the previous page passes through the secondary transfer position (ACT207). The secondary transfer position is a position in which the toner image on the intermediate transfer belt 13 is transferred onto the sheet from the paper feeding unit 140 by the secondary transfer roller 121. That is, if it is determined that the previous page passes through the secondary transfer position, the secondary transfer of the previous page is completed.

If it is determined that the previous page passes through the secondary transfer position, the voltage control unit 153 applies the cleaning bias $V_{CB}$ between pages to the secondary transfer roller 121 between pages (ACT208). That is, the voltage control unit 153 applies the cleaning bias $V_{CB}$ to the secondary transfer roller 121 before the secondary transfer of the next page (n page) is performed. Therefore, the voltage control unit 153 reversely transfers the fog toner accumulated in the secondary transfer roller 121 onto the intermediate transfer belt 13. Thus, the fog toner that is reversely transferred onto the intermediate transfer belt 13 is cleaned by the belt cleaner 200 and then is removed.

On the other hand, if it is determined that the previous page (n−1 page) is absent during the same printing operation, the voltage control unit 153 applies the cleaning bias $V_{CB}$ to the secondary transfer roller 121 (ACT206).

The voltage control unit 153 executes the secondary transfer of the toner image onto the sheet after applying the cleaning bias $V_{CB}$ to the secondary transfer roller 121. Thus, the voltage control unit 153 moves to the bias between pages and completes the page management operation of the pages. Moreover, if it is determined that the previous page does not pass through the secondary transfer position, the voltage control unit 153 does not apply the cleaning bias $V_{CB}$ to the secondary transfer roller 121.

Figure 6:
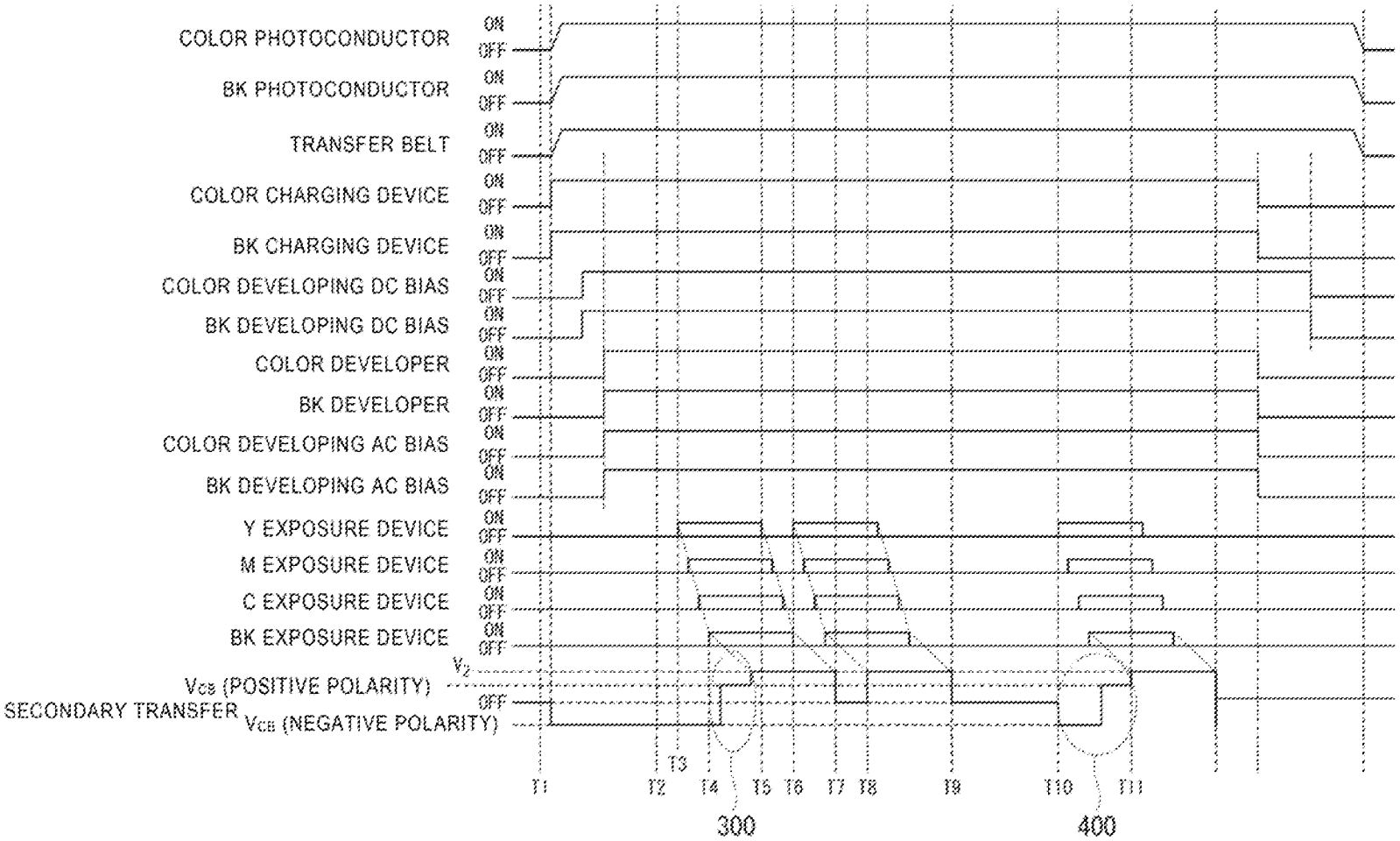
FIG. 6 is a timing chart of operations of the printing process of the plurality of pages of the image forming apparatus.

FIG. 6 is a timing chart of an operation of the printing process of a plurality of pages of the image forming apparatus 1 of the embodiment.

If the power supply of the image forming apparatus 1 is turned on by the user, the image forming apparatus 1 determines whether or not there is a printing instruction of an image (time T1). If it is determined that there is the printing instruction of the image, the image forming apparatus 1 starts the print start-up operation for printing the image. The image forming apparatus 1 performs the image procedure to retrieve the image data of the page. If it is determined that the image procedure to retrieve the image data of the page is completed (time T2), the image forming apparatus 1 starts the exposure of the exposure devices 24Y, 24M, 24C, and 24K (time T3).

At a time point of time T4, the image forming apparatus 1 determines that there is not the previous page during the same printing operation. That is, the image forming apparatus 1 determines that a sheet to be secondarily transferred is a head (first page) of the pages. Therefore, the voltage control unit 153 applies the cleaning bias $V_{CB}$ to the secondary transfer roller 121 (300 in FIG. 6).

Thus, the voltage control unit 153 executes the secondary transfer of the toner image onto the sheet of the first page. Here, the image forming apparatus 1 completes the image procedure of the second page at a time point of time T5. Therefore, the image forming apparatus 1 transfers the toner image that is transferred onto the second page onto the intermediate transfer belt 13 at time T6.

The voltage control unit 153 executes the secondary transfer of the second page after executing the secondary transfer of the toner image onto the sheet of the first page at time T7 without performing the idle operation of the secondary transfer roller 121 (time T8). Otherwise, if the time of the idle operation of the secondary transfer roller 121 is less than a predetermined time after executing the secondary transfer of the first page at the time T7, the voltage control unit 153 executes the secondary transfer of the second page. In this case, the voltage control unit 153 does not apply the cleaning bias $V_{CB}$ to the secondary transfer roller 121 after executing the secondary transfer of the first page.

At time T9 at which the secondary transfer of the second page is completed, the image forming apparatus 1 determines that there is a printing process of a third page. However, since the image procedure of the third page is not completed, the image forming apparatus 1 performs the idle operation of the secondary transfer roller 121 and waits for the completion of the image procedure of the third page.

If the image procedure of the third page is completed at time T10, the voltage control unit 153 applies the positive cleaning bias $V_{CB}$ and then the negative cleaning bias $V_{CB}$ to the secondary transfer roller 121 (400 of FIG. 6).

Thus, the voltage control unit 153 executes the secondary transfer of the third page after application of the cleaning bias $V_{CB}$ (time T11).

Figure 7:
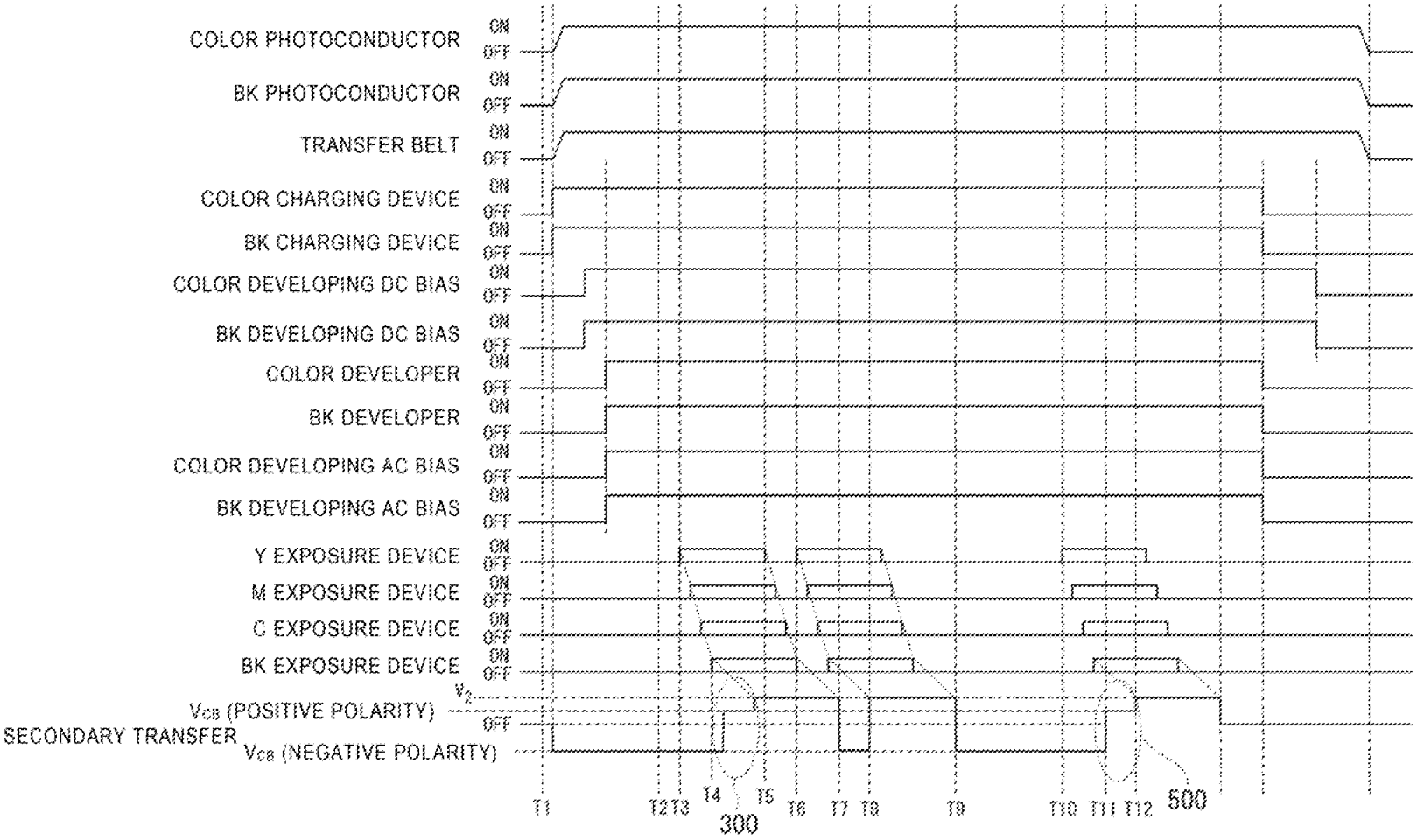
FIG. 7 is a timing chart of operations of the printing process of the plurality of pages of the image forming apparatus according to a first modification example.

Moreover, as illustrated in FIG. 7, if the negative voltage that is a reversed polarity is applied as the bias between pages, the voltage control unit 153 may apply the positive voltage as the cleaning bias $V_{CB}$ before the secondary transfer of the next page (500 of FIG. 7). For example, the voltage control unit 153 applies the bias of the positive polarity of one type as the cleaning bias $V_{CB}$ before the secondary transfer of the next page by applying the voltage of the negative polarity at time T9.

Figure 8:
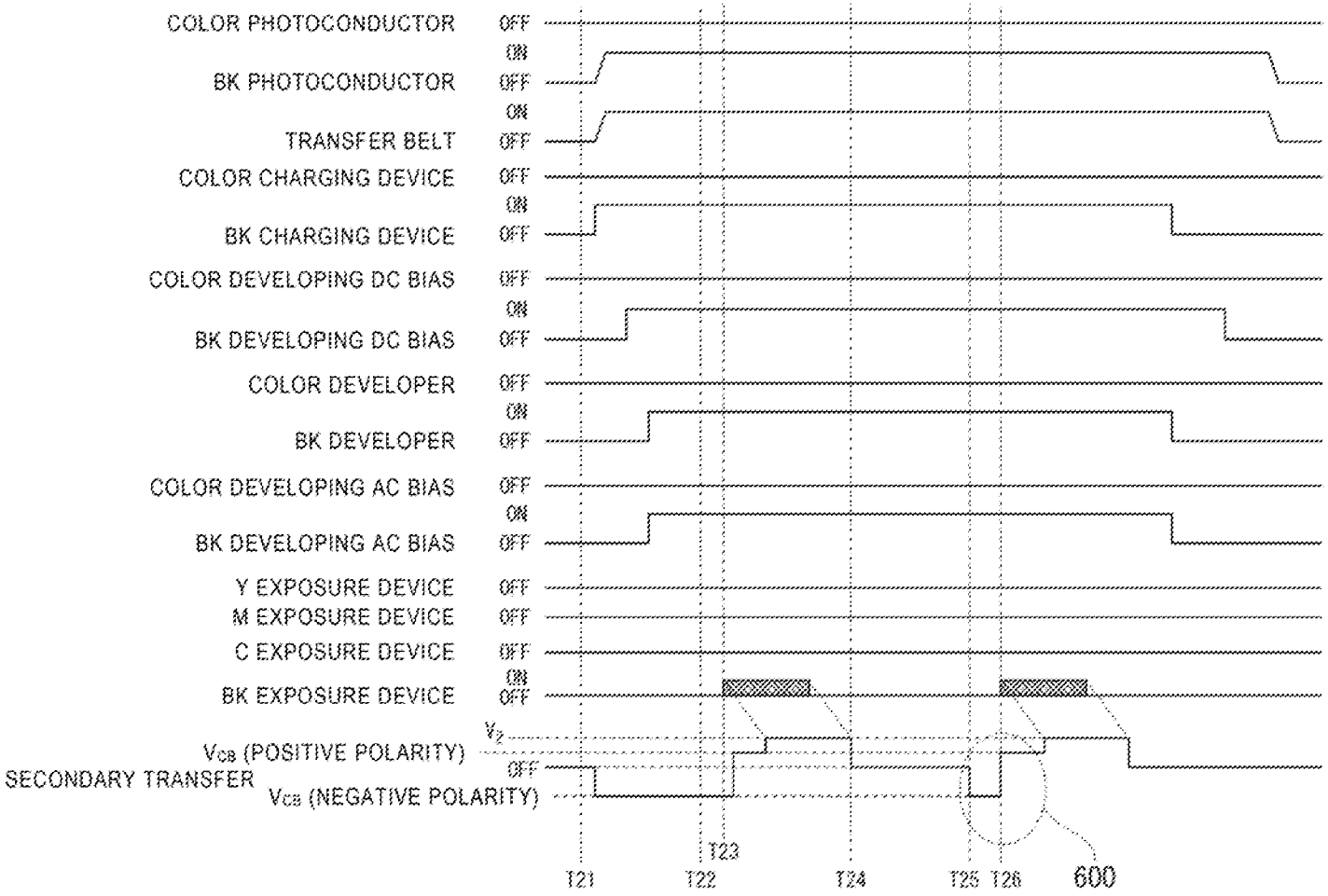
FIG. 8 is a timing chart of operations of the printing process of the plurality of pages of the image forming apparatus according to a second modification example.

In addition, in a case of the monochrome printing process, it may not take substantial time for applying the cleaning bias $V_{CB}$ of one revolution time until the toner image transferred on the intermediate transfer belt 13 reaches the secondary transfer position. In such a case, as illustrated in FIG. 8, the control unit 15 provides a delay time until image reading (time T26) after the completion of the image procedure (time T25). Thus, the control unit 15 applies the cleaning bias $V_{CB}$ of two types substantially during one revolution time respectively to the secondary transfer roller 121 (600 of FIG. 8). Therefore, even in a case of the monochrome printing process, it is possible to prevent backside contamination of an image when the idle time is lengthened to wait for the procedure to get the image data.

In at least one of the embodiments described above, if there is the idle operation of the secondary transfer roller 121, the cleaning bias $V_{CB}$ is applied to the secondary transfer roller 121. Therefore, the fog toner is prevented from adhering to the back of the sheet of the next page.

All or a part of the functions of the control unit 15 record programs (image forming programs) for implementing these functions on a computer-readable recording medium. Thus, the program that is recorded on the recording medium may be realized by being executed by a CPU.

In addition, the "computer-readable recording medium" is a portable medium and a storage unit. For example, the portable medium is a flexible disk, a magneto-optical disk, a ROM, and a CD-ROM. For example, the storage unit is a hard disk built in a computer system. Furthermore, the "computer-readable recording medium" is provided to dynamically hold network and programs during a short time, and to hold programs for a constant period of time. For example, the network is an Internet. For example, those that dynamically hold the programs are communication lines when the program is transmitted via the communication lines. For example, those that hold the programs for a constant period of time are volatile memories inside the computer system serving as a server or a client. In addition, the program may be one for implementing a part of the functions described above. Furthermore, the functions described above may be further implemented in combination with a program that is already recorded in the computer system.

What is claimed is:

1. An image forming apparatus comprising:

an image carrier body;

an intermediate transfer body;

an exposure device configured to form, with respect to an Nth page of a plurality of pages of a print job, an electrostatic latent image on the image carrier body based on image data of the Nth page;

a developing device configured to provide, with respect to the Nth page, toner to the image carrier body having the electrostatic latent image formed thereon to thereby form a toner image on the image carrier body;

a primary transfer member configured to transfer, with respect to the Nth page, the toner image formed on the image carrier body onto the intermediate transfer body;

a secondary transfer member configured to perform a transfer operation in which the toner image, with respect to the Nth page, is secondarily transferred from the intermediate transfer body onto a recording medium, and an idle operation after the toner image is secondarily transferred onto the recording medium with respect to the Nth page and before a toner image is to be secondarily transferred onto another recording medium with respect to an Nth+1 page of the plurality of pages of the print job; and a control unit configured to apply a cleaning bias to the secondary transfer member while the idle operation of the secondary transfer member is being performed for a time exceeding a predetermined period of time.

2. The apparatus according to claim 1, wherein the control unit applies a positive voltage and a negative voltage sequentially to the secondary transfer member as the cleaning bias.

3. The apparatus according to claim 1, wherein a secondary transfer bias is applied to the secondary transfer member to secondarily transfer the toner image, and an absolute value of the cleaning bias is smaller than an absolute value of the secondary transfer bias.

4. The apparatus according to claim 1, wherein the exposure device forms a subsequent electrostatic latent image corresponding to a new page of the print job on the image carrier body before the toner image corresponding to a previous page of the print job is secondarily transferred.

5. The apparatus according to claim 1, wherein the idle operation is a state where the secondary transfer member continually rotates without applying a secondary transfer bias to the secondary transfer member for secondarily transferring the toner image.

6. The apparatus according to claim 1, wherein the control unit applies cleaning bias to the secondary transfer member at a timing after the print job being received and before a toner image is to be secondarily transferred onto a first recording medium with respect to a first page of the plurality of pages of the print job.

7. An image forming apparatus comprising:

an image forming unit configured to form, with respect to an Nth page of a plurality of pages of a print job, a toner image on an image carrier body based on image data of the Nth page;

a primary transfer member configured to transfer, with respect to the Nth page, the toner image formed on the image carrier body onto an intermediate transfer body;

a secondary transfer member configured to perform a transfer operation in which the toner image, with respect to the Nth page, is secondarily transferred from the intermediate transfer body onto a recording medium, and an idle operation after the toner image is secondarily transferred onto the recording medium with respect to the Nth page and before a toner image is to be secondarily transferred onto another recording medium with respect to an Nth+1 page of the plurality of pages of the print job; and a control unit configured to apply a cleaning bias to the secondary transfer member while the idle operation of the secondary transfer member is being performed for a time exceeding a predetermined period of time.

8. The apparatus according to claim 7, wherein the control unit applies a positive voltage and a negative voltage sequentially to the secondary transfer member as the cleaning bias.

9. The apparatus according to claim 7, wherein a secondary transfer bias is applied to the secondary transfer member to secondarily transfer the toner, and an absolute value of the cleaning bias is smaller than an absolute value of the secondary transfer bias.

10. The apparatus according to claim 7, wherein the image forming unit forms a subsequent electrostatic latent image corresponding to a new page of the print job on the image carrier body before the toner image corresponding to a previous page of the print job is secondarily transferred.

11. The apparatus according to claim 7, wherein the idle operation is a state where the secondary transfer member continually rotates without applying a secondary transfer bias to the secondary transfer member for secondarily transferring the toner image.

12. The apparatus according to claim 7, wherein the control unit applies cleaning bias to the secondary transfer member at a timing after the print job being received and before a toner image is to be secondarily transferred onto a first recording medium with respect to a first page of the plurality of pages of the print job.

13. A method of forming an image in an image forming apparatus comprising the steps of:

receiving a print job having a plurality of pages to be printed;

forming, with respect to an Nth page of a plurality of pages of the print job, an electrostatic latent image on image carrier body based on image data of the Nth page;

providing, with respect to the Nth page, toner to the image carrier body having the electrostatic latent image formed thereon to thereby form a toner image on the image carrier body;

transferring, with respect to the Nth page, the toner image formed on the image carrier body onto the intermediate transfer body;

applying a secondary transfer bias to a secondary transfer member;

secondarily transferring, with respect to the Nth page, the toner image from the intermediate transfer body onto a recording medium conveyed between the intermediate transfer body and the secondary transfer member having the secondary transfer bias applied thereto;

performing an idle operation with the secondary transfer member after the toner image is secondarily transferred onto the recording medium with respect to the Nth page and before a toner image is to be secondarily transferred onto another recording medium with respect to an Nth+1 page of the plurality of pages of the print job; and when the idle operation is performed for a time exceeding a predetermined period of time, applying a cleaning bias to the secondary transfer member while the idle operation of the secondary transfer member is being performed.

14. The method according to claim 13, further comprising:

applying the cleaning bias to the secondary transfer member at a timing after the print job is received and before a toner image is secondarily transferred onto a first recording medium with respect to a first page of the plurality of pages of the print job.

* * * * *